US007547008B2

(12) United States Patent
Belanger

(10) Patent No.: US 7,547,008 B2
(45) Date of Patent: Jun. 16, 2009

(54) PRINTED PRODUCT COLLECTING DEVICE AND METHOD

(75) Inventor: Roger Robert Belanger, Dover, NH (US)

(73) Assignee: Goss International Americas, Inc., Dover, NH (US)

( * ) Notice: Subject to any disclaimer, the term of this patent is extended or adjusted under 35 U.S.C. 154(b) by 174 days.

(21) Appl. No.: 11/304,094

(22) Filed: Dec. 15, 2005

(65) Prior Publication Data

US 2007/0138727 A1 Jun. 21, 2007

(51) Int. Cl.
*B65H 39/00* (2006.01)

(52) U.S. Cl. ..... 270/52.15; 270/52.14; 270/52.16; 270/52.19; 270/52.2; 270/52.21; 270/52.22; 270/52.26; 270/52.29; 270/52.04; 270/52.05

(58) Field of Classification Search ..... 270/52.14, 270/52.15, 52.16, 52.19, 52.2, 52.21, 52.22, 270/52.26, 52.29, 52.04, 52.05
See application file for complete search history.

(56) References Cited

U.S. PATENT DOCUMENTS 3,317,026 A 5/1967 Zugel et al. ..... 198/133
5,280,895 A * 1/1994 Meier ..... 270/58.03
5,660,382 A * 8/1997 Meier ..... 270/52.16
5,673,910 A * 10/1997 Wamsley ..... 271/259
5,788,446 A 8/1998 Stolz ..... 412/9
6,082,724 A 7/2000 Kahlig et al. ..... 270/52.14
6,267,366 B1 7/2001 Graushar et al.
6,690,996 B2 2/2004 Seiler ..... 700/228
2005/0225023 A1 10/2005 Schlough ..... 271/69
2006/0103064 A1 * 5/2006 Sittinger et al. ..... 270/52.14

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A collecting device for forming a printed product includes a conveyor and a plurality of printed material delivery devices, the plurality of printed material delivery devices including a first delivery device for first printed materials and a second delivery device for second printed materials. A first transfer device is assigned to the first delivery device and delivering the first printed materials to the conveyor and a second transfer device assigned to the second delivery device and delivering the second printed materials to be collected with the first printed materials on the conveyor. Each of the first and second transfer devices have printed material buffer positions between the respective first and second delivery devices and the conveyor, which permit advantageous reduction in the amount of waste.

13 Claims, 6 Drawing Sheets

PRINTED PRODUCT COLLECTING DEVICE AND METHOD

BACKGROUND OF THE INVENTION

The present invention relates generally to devices for collecting printed products such as a gatherer or newspaper inserter, and to methods for collecting printed products.

U.S. Pat. No. 6,082,724 describes a signature collating apparatus such as an inserter having a plurality of hoppers delivering sheet materials to newspapers in pockets. Repair sheet material article feeders can be provided. U.S. Pat. No. 6,082,724 is hereby incorporated by reference herein.

U.S. Pat. No. 6,690,996 discloses a method and device for the sequential supply of articles to be processed including gripper conveyors. U.S. Pat. No. 6,690,996 is hereby incorporated by reference herein.

U.S. Patent Application Publication No. 2005/0225023 discloses a saddle conveyor and is hereby incorporated by reference herein. U.S. Pat. No. 3,317,026 discloses a saddle stitcher and U.S. Pat. No. 5,788,446 a perfect binder, both of which are hereby incorporated by reference herein.

BRIEF SUMMARY OF THE INVENTION

Collecting devices such as inserters may have for example ten or more hoppers providing for example advertising inserts to a newspaper jacket held open in a pocket conveyor. A saddle stitcher or perfect binder gatherer may for example collect folded printed materials from hoppers onto a saddle or perfect binder conveyor, respectively, to form a magazine or other printed product.

The hoppers sometimes misfeed during transfer, often via a transfer drum, to the conveyor, for example by not providing a printed material or providing a double. If a double is provided, the collected product on the conveyor can be discarded. If a hopper fails to feed a printed material, repair may be provided, for example, by actuating a duplicate repair hopper further down the inserting line to provide the missing printed material. In some cases, for example with pocket conveyors, the pockets can be recycled past the hopper that misfed to provide the missing material. As an alternative to the automatic repair systems, the conveyor may be stopped and the product repaired by hand.

The present invention provides a collecting device for forming a printed product comprising:

a conveyor;

a plurality of printed material delivery devices, the plurality of printed material delivery devices including a first delivery device for first printed materials and a second delivery device for second printed materials, a first transfer device assigned to the first delivery device and delivering the first printed materials to the conveyor;

a second transfer device assigned to the second delivery device and delivering the second printed materials to be collected with the first printed materials on the conveyor;

each of the first and second transfer devices having printed material buffer positions between the respective first and second delivery devices and the conveyor, the number of buffer positions for the first transfer device being equal to or greater than a number of all of the plurality of collecting devices, and a controller determining when the first transfer device has a certain buffer position empty or to be inhibited from delivery when the certain buffer position passes a first location of the conveyor, the controller inhibiting delivery of the second printed material from the second delivery device to the first location as the first location moves past the second delivery device.

By being able to inhibit the delivery of the second printed material where no first printed material is located, the collecting device can avoid creating any collected products which must be rejected or repaired. Each product collected on the conveyor may be complete, leading to paper and time savings.

The collecting device may further include a sensor for sensing a misfeed of one of the first printed materials, the certain buffer position corresponding to a misfeed position. The certain buffer position thus may correspond to the absence of the first printed product or to two or more of the first printed material being delivered from the hopper to the first transfer device, for example doubles or triples.

If the misfeed sensor senses two or more of the first printed materials, the transfer device may release the first printed materials into a recycle bin for reuse later.

The inhibited second printed material may be recycled by the second transfer device, and then the second delivery device inhibited as the recycled second printed material passes by the second delivery device.

The first and second delivery devices may be sheet material hoppers, for example.

The first and second transfer devices may be gripper conveyors, for example, with each buffer position corresponding to a gripper. The transfer device length could be reduced via shingling of printed material held by the grippers.

The conveyor for example may be a pocket conveyor with the first location corresponding to a pocket, a saddle conveyor, or a perfect binder conveyor.

Preferably, the number of printed material delivery devices is at least four, and most preferably at least eight.

The second transfer device may be downstream from the first transfer device with respect to the conveyor.

The conveyor and/or transfer devices can be driven by individual servo motors which can be controlled by the controller so that for example a blank position on the conveyor can be avoided.

The present invention provides a method for forming a printed product comprising:

moving a conveyor;

conveying a first stream of first printed materials and then delivering the first printed materials at a first delivery location onto the conveyor;

conveying a further stream of second printed materials and then delivering the further printed materials at further delivering locations onto the conveyor so as to collect the first and further printed materials together to form a completed printed product, determining if the first stream of first printed materials includes a misfeed at a misfeed location, the first printed material at the misfeed location, if any, not being delivered on the conveyor at a misfeed conveyor location; and inhibiting delivering the further printed materials to the misfeed conveyor location as the conveyor moves past the further delivering locations.

The present invention also provides a collecting device for forming a printed product comprising:

a conveyor;

a first printed material delivery device;

a second printed material delivery device;

a first transfer device assigned to the first printed material delivery device and delivering first printed materials to the conveyor;

a second transfer device assigned to the second printed material delivery device and delivering second printed materials to the conveyor to be collected with the first printed materials, the second transfer device being downstream of the first transfer device with respect to the conveyor; and a controller determining if the second transfer device has a misfeed at a misfeed location, and if so, controlling the first transfer device to inhibit delivering of one of the first printed materials at a conveyor location on the conveyor, the conveyor location passing by the second transfer device when the misfeed location is located at the conveyor.

The present invention thus advantageously provides upstream control of the transfer devices so that partially formed products need not be produced.

The present invention also provides a collecting device for forming a printed product comprising:

a conveyor;

a first printed material delivery device;

a first transfer device assigned to the first printed material delivery device and delivering first printed materials to the conveyor; and a controller capable of inhibiting delivery of one of the first printed materials by the first transfer device to the conveyor, recycling the one of the first printed materials past the first printed material device, and inhibiting the first printed material delivery device as the one of the first printed materials recycles past the first printed material delivery device.

The present invention also provides a collecting device for forming a printed product comprising:

a conveyor;

a first printed material delivery device;

a first transfer device assigned to the first printed material delivery device and delivering first printed materials to the conveyor, the transfer device having a gripper;

a sensor sensing when the gripper grips more than one of the first printed materials; and a controller releasing the gripper to reject the more than one of the first printed materials prior to the gripper reaching the conveyor.

The present invention also provides a collecting device for forming a printed product comprising:

a conveyor having a first receiving location and a neighboring second receiving location;

a first printed material delivery device;

a second printed material delivery device;

a first transfer device assigned to the first printed material delivery device and delivering first printed materials to the conveyor;

a second transfer device assigned to the second printed material delivery device and delivering second printed materials to the conveyor to be collected with the first printed materials; and a controller determining if the first transfer device has a misfeed at a misfeed location, the first transfer device having a forward location downstream of the misfeed location with a first of the first printed materials and a rear location with a second of the first printed materials upstream of the misfeed location, the controller controlling the first transfer device, the second transfer device and the conveyor so that the first of the first printed materials arrives in the first receiving location and the second of the first printed materials arrives in the neighboring second receiving location.

With this device, the number of buffer positions advantageously could be less than the number of hoppers and/or empty spaces in the conveyor can be avoided. Recycling for other transfer devices can be avoided.

The present invention also provides a method for reducing incomplete collected products comprising:

moving a conveyor having a plurality of printed material receiving locations;

conveying a first stream of first printed materials and then delivering first printed materials at a first delivery location onto the conveyor;

conveying a second stream of second printed materials and then delivering the second printed materials at a second delivering location onto the conveyor so as to collect the first and second printed materials together, determining if the first stream of first printed materials includes a misfeed at a misfeed location, the first stream having a forward location downstream of the misfeed location with one of the first printed materials and a rear location with another of the first printed materials upstream of the misfeed location;

the one of the first printed materials being delivered to a first of the printed material receiving locations; and accelerating the first stream and/or decelerating the conveyor and the second stream so that the other printed material in the rear location arrives at a second of the printed material receiving locations, the second printed receiving material location being located next to the first printed material receiving location.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
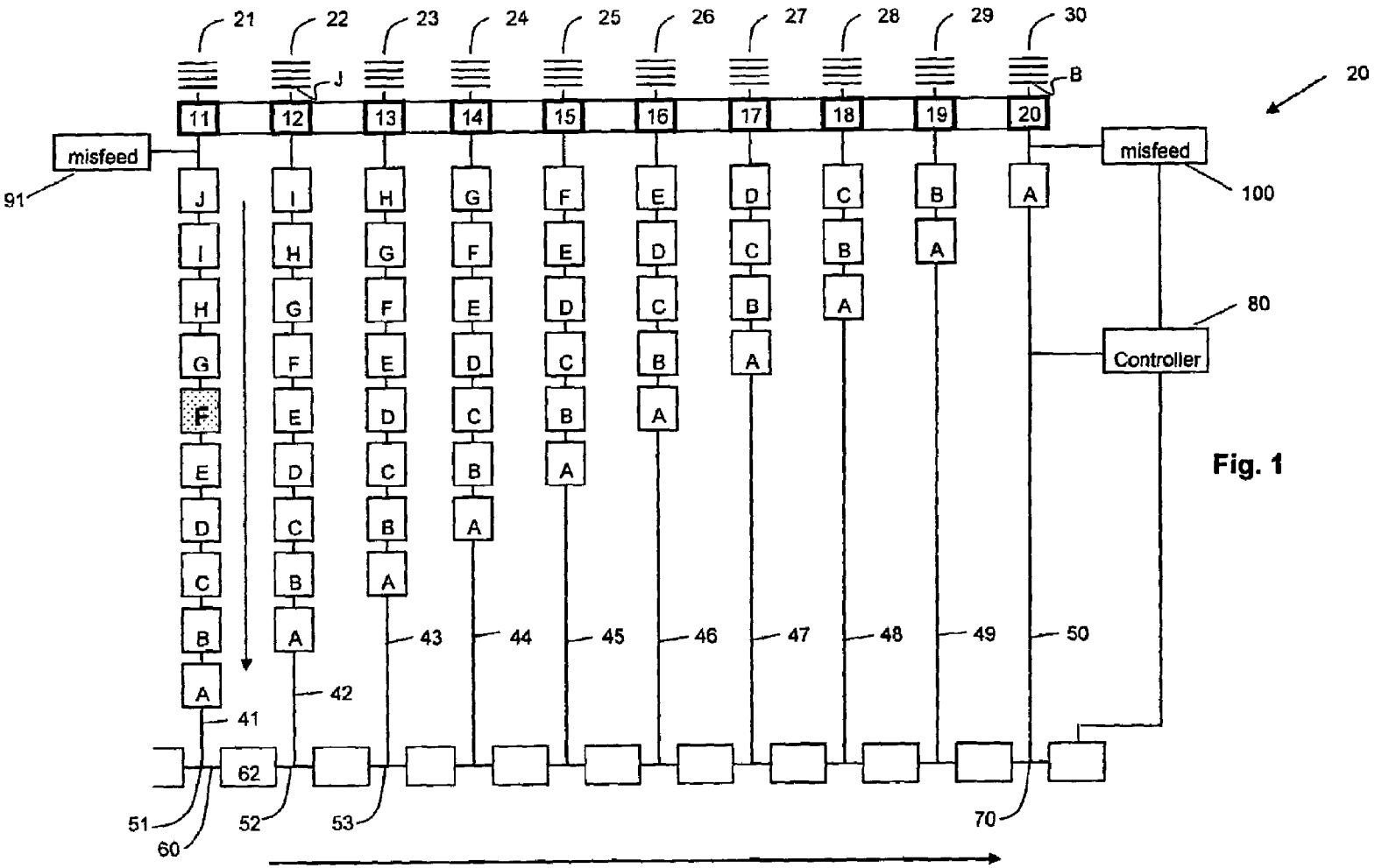
FIG. 1 shows schematically a collecting device with at least ten hoppers with delivery of printed materials to form a product A about to begin.

FIG. 1 schematically a collecting device 20 with ten hoppers 11, 12, 13, 14, 15, 16, 17, 18, 19, 20, and ten transfer devices 41, 42, 43, 44, 45, 46, 47, 48, 49, 50 and a conveyor 60 with printed material receiving locations 62.

Hoppers 11, 12, 13, 14, 15, 16, 17, 18, 19, 20 deliver respectively printed materials to the transfer devices 41, 42, 43, 44, 45, 46, 47, 48, 49, 50. The printed materials may be for example inserts or book sections to be collected at the conveyor 60. Hopper 11 may deliver printed materials 21 via transfer device 41 to conveyor 60 at a delivery location 51. Hopper 12 may deliver printed materials 22 to conveyor 60 via transfer device 42 at a delivery location 52, and hopper 13 printed materials 23 via transfer device 43 at a deliver location 53, etc. Each transfer device 41, 42, etc. to 50 shown in this embodiment has at least ten buffer positions, i.e. at least the number of buffer positions as the number of hoppers, between a respective hopper 11, 12, etc. to 20 and the conveyor 60.

As an example, the conveyor 60 could be a pocket conveyor where receiving locations 62 are individual pockets as described in incorporated by reference U.S. Pat. No. 6,082,724. A newspaper jacket held open in the pocket then approaches the first delivery location 51 where the first printed material insert is placed in the jacket, then the second delivery location 52 where the second printed material insert is placed in the jacket, then the third delivery location 53 where the third printed material 23 is placed in the jacket, etc., until the newspaper exits after a final delivery location 70 for transfer device 50. At this point for example ten different inserts have been collected properly in the newspaper jacket and the newspaper is complete and ready for further transport.

As shown then in FIG. 1, one product to be completed on the conveyor 60 will thus have a plurality of different collected printed materials 21, 22, 23, etc from the hoppers. A first product to be collected thus can be designated A, a second product B, a third product C, through products D, E, F, G, H, I, J etc. FIG. 1 then shows the printed materials in the transfer devices 41 to 50 assigned to the product A, B, C, etc. to be formed. As shown in FIG. 1, a first printed material for product A is about to enter conveyor 60 from a last buffer position of transfer device 41 and a tenth printed material for product A has just left hopper 20 and is in a first buffer position of transfer device 50.

A sensor, such as misfeed sensors 91 and 100 as shown, can be provided for each transfer device 41 to 50 or hopper 11 to 20, to detect a problem with the transport of the printed materials 21, 22, 23 etc. For example, typically only one printed material should be fed to each buffer position in the transfer devices. However, the sensor 91 can detect the presence of more than one printed material 21 being fed to the transfer device 41, or the absence of the printed material 21. Sensor 91 or another sensor also can detect a home position on the transfer device 41, so that the location of the misfeed or problem can be determined.

For example, a controller 80 can control individual servo motors for each hopper, individual servo motors for each transfer device 41 and a servo motor for conveyor 60. By knowing a home position of the transfer device 41, for example where the buffer position holding printed material for product A is, the spacing of the buffer positions, and the number of rotations of the servo motor since the home position has past the sensor 91 and the angular position of the servo motor, the location of each buffer position is known. Thus as a buffer position passes the misfeed sensor 91, if a misfeed is detected, the controller 80 can identify a specific buffer position as having a misfeed for example. The sensor 91 advantageously is a misfeed sensor for misses or doubles or triples, however it could also be another type of sensor that detects some other characteristic of the printed material such as poor quality such as smeared print or a dog-ear, or to detect a bar code or other specific information related to the printed material.

As shown then in FIG. 1, at a buffer position in transfer device 41 corresponding to the first printed material for a future completed product F, the hopper 21 misfed the first printed material to transfer device 41 and the buffer position is empty or contains two or more of the first printed materials, or otherwise contains first printed material which is not be delivered to the conveyor.

Figure 2:
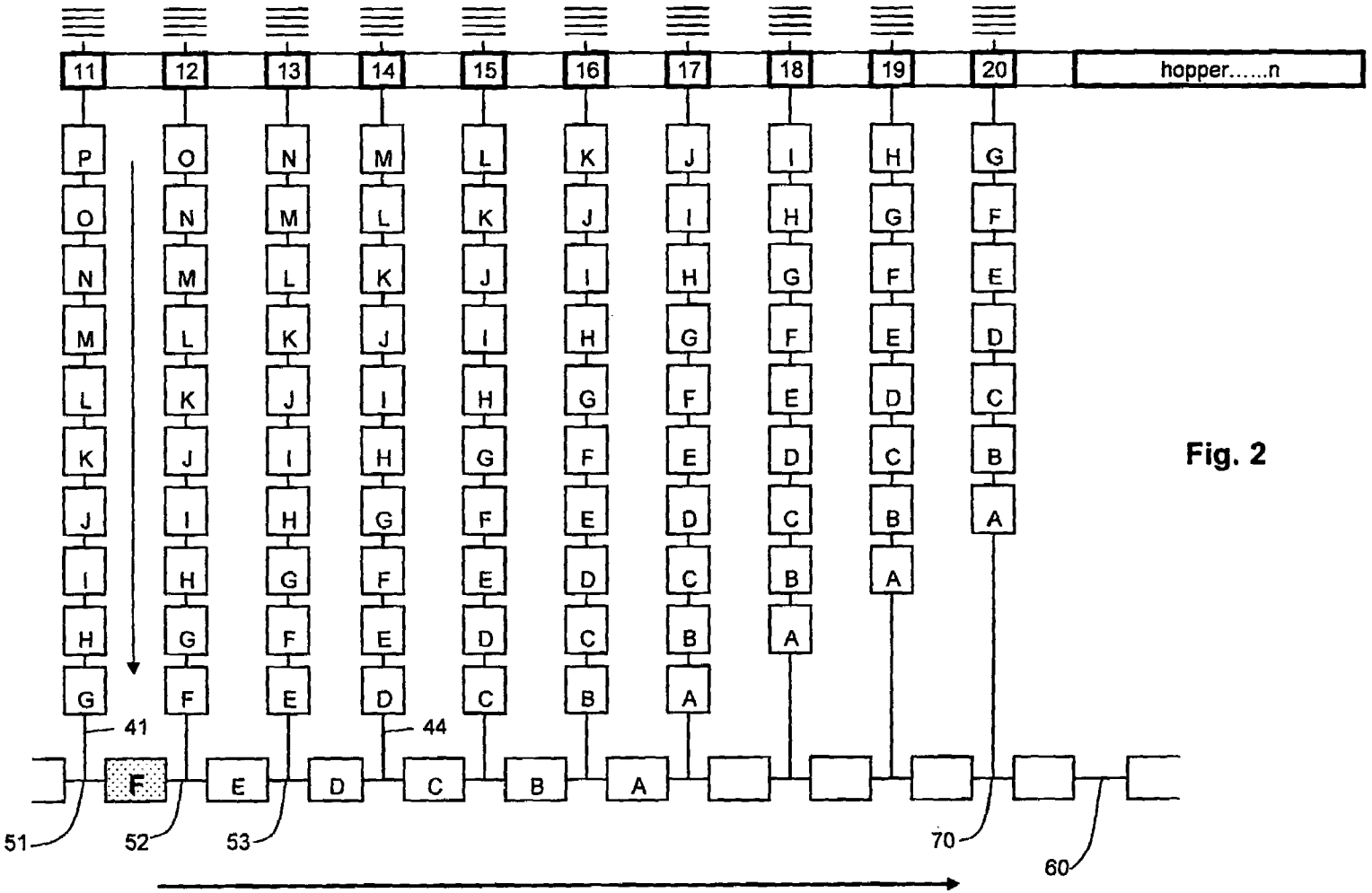
FIG. 2 shows the collecting device as the formation of product A has progressed.

As shown in FIG. 2, products A, B, C, D, E are being formed on the conveyor 60, with unfinished product A having collected printed materials from hoppers 11, 12, 13, 14, 15 and 16 and about to receive the seventh printed material from hopper 17, unfinished product B having collected five printed materials from hoppers 11, 12, 13, 14 and 15 etc. However, since the first printed sheet material for a desired product F was a misfeed, transfer device 41 does not deliver the first printed material, if any, from the corresponding buffer position to the conveyor 60 at location 51 as shown in FIG. 2.

The controller 80 (FIG. 1) now can inhibit all further transfer devices 41 through 50 from delivering the respective sheet material for a desired product F, so that the space for product F for example remains blank through the entire product formation process. The printed sheet materials which were to be delivered to the space for product F can be recirculated, and the respective hopper inhibited for that product buffer location. Thus no partial product F is formed and waste can be reduced and/or throughput improved.

Likewise, if a misfeed sensor on transfer device 48 (FIG. 1) senses a miss, the controller 80 can inhibit upstream transfer devices 41, 42, 43, 44, 45, 46 and 47, and well and 49 and 50 from delivering product into the conveyor location intended for that product. Thus, for example if the transfer gripper for product C in FIG. 1 is a misfeed location, controller 80 will control all transfer devices including transfer device 41 from delivering the first printed material to the conveyor at location 51, and instead recycle the printed material. Multiple misfeeds in different transfer devices thus can also be handled.

Alternate to leaving a blank space on the conveyor 60, the controller also can control the servo motors from the hoppers, transfers devices and conveyor to have desired product G be located in the former F position for the conveyor. For example, if the conveyor 60 is to remain at a constant speed, once the first printed material for product E is delivered at location 51, transfer device 41 can be accelerated so that product G is delivered in the former product F location. As the conveyor passes each of the delivery locations 51, 52, 53, etc. each transfer device can be accelerated after the printed material for product E is delivered, the printed material for product F is inhibited from delivery, and the printed sheet material for product G is delivered in the former F space. The transfer device can then be returned to the previous speed.

Alternately, since the printed materials typically are not unique within the hoppers, only the one transfer device 41 with the misfeed needs to be accelerated to skip the-misfed buffer location and the other transfer devices 42 etc. can run at a same speed and deliver printed material assigned for former product F to product G. Alternately, the conveyor and all other transfer devices other than the one with a misfeed could be slowed as the transfer device with the misfeed runs at a same speed. A combination of slowing the conveyor and other transfer devices and accelerating a transfer device could also be used. For example acceleration of the one transfer device could be used when only a single misfeed is present, but slowing of the conveyor and other transfer devices could be used, alone or with acceleration of the transfer device with the misfeed, when two or more misfeeds are located in a row in one transfer device.

Slowing of the conveyor and other transfer devices may be preferable, as acceleration of the transfer device and thus the related hopper could itself lead to misfeeds. Also multiple misfeeds in a row can be handled more easily. If the misfeed gap is for example two printed materials or buffer locations, the conveyor and other transfer devices could be slowed as follows:

Assume the conveyor and transfer devices are running at a speed of 60 meters per minute, and each receiving conveyor location is spaced at 0.5 m and each gripper of the transfer device is spaced 0.5 m apart. Two printed materials are being delivered each second by each transfer device onto the conveyor. A misfeed gap of two grippers is sensed in one of the transfer devices. Once the transfer device delivers the forward printed material upstream of the misfeed gap to the conveyor, the controller slows down the conveyor and all other transfer devices except the one with the misfeed gap. The rear printed material downstream of the misfeed gap in the transfer device will arrive 1.5 seconds later at the conveyor (the first misfeed gripper arrives at 0.5 seconds and the second misfeed gripper at 1.0 seconds), so the controller decelerates the conveyor and then again accelerates the conveyor back up to 60 meters per second so that the average speed of the conveyor and the other transfer devices during the 1.5 seconds is 20 meters per second (i.e. travels 0.5 meters in 1.5 seconds). A variety of speed profiles could be used to achieve this average speed.

With such servo drive control, the number of buffer positions also could be reduced to fewer than the number of hoppers. While this will not ensure that no partial books are made, only a string of misfeeds longer than the number of buffer positions will result in a partial book. If for example the buffer position number is four or more, most waste will be eliminated as string of four misfeeds is unlikely.

However, the preferred embodiment is to have the number of buffer positions equal to or greater than the number of hoppers and no acceleration or deceleration control, so that positions unfilled by all the hoppers can remain on the conveyor.

Figure 3:
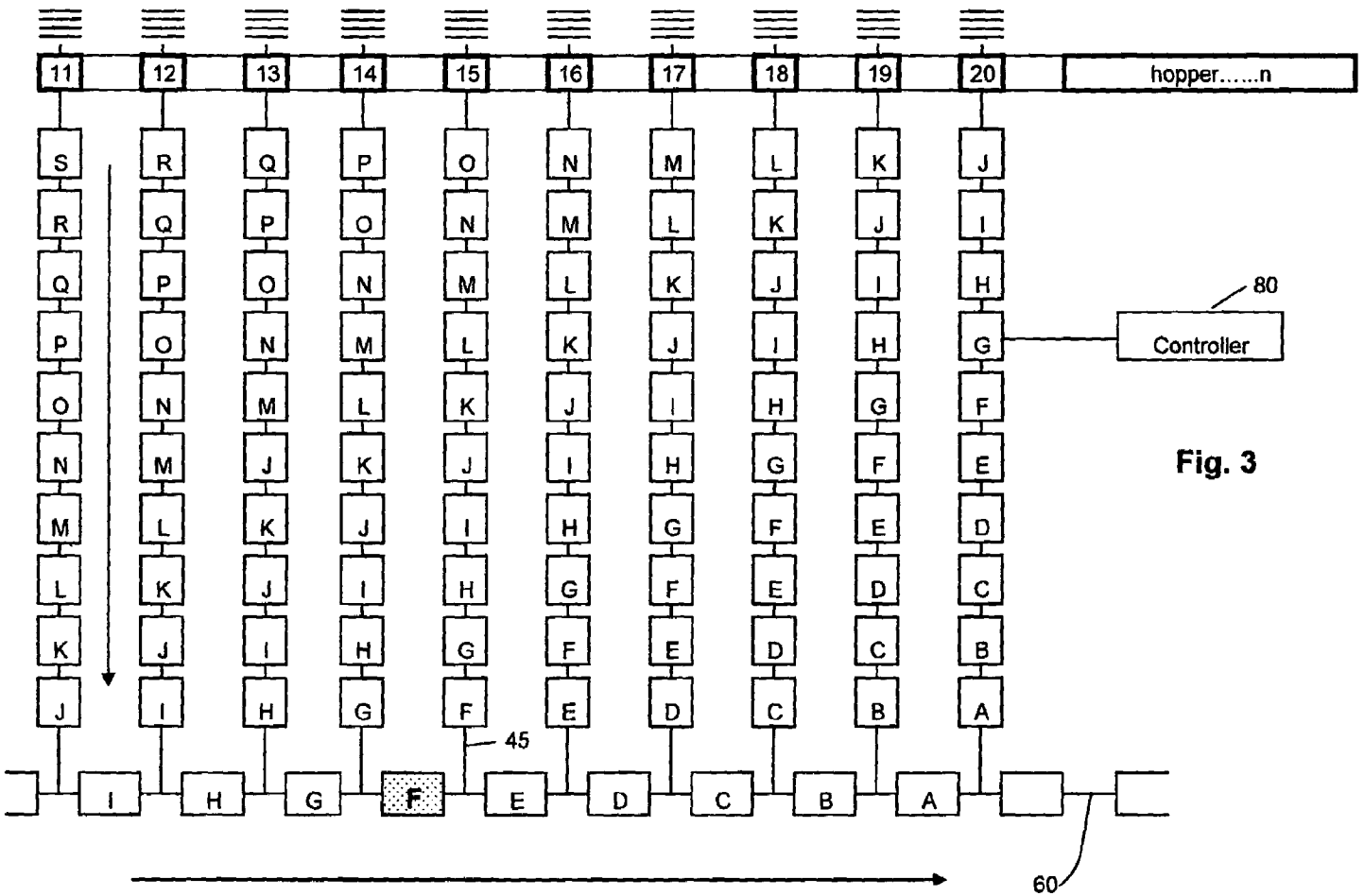
FIG. 3 shows the collecting device as in FIG. 1 with product A comprising ten printed materials complete.

FIG. 3 shows conveyor 60 with an empty position where product F was to be formed. Previously, controller 80 had inhibited transfer devices 42, 43, 44 from delivering printed material for product F. Controller 80 then inhibits transfer device 45 from delivering the printed material from hopper 15 in buffer location with the material for product F, i.e. the last buffer position in transfer device 45 shown in FIG. 3. Controller 80 inhibits transfer devices 46 to 50 as the location for F passes those transfer devices. The position for product F on conveyor 60 thus receives no printed material from any of the hoppers, and no product which needs to be discarded need be created.

If device 20 is an inserter, a newspaper jacket or other incoming material may already be in a pocket as the conveyor enters device 20. In this case, the device 20 still provides an advantage in that no inserts are placed in the newspaper jacket if a misfeed occurs and the jacket can be recycled and run through again or potentially could be discarded. Preferably however, the device is such that the device 20 forms entire products using the hopper sections, such as may occur with a saddle stitcher or perfect binder, and the location for an unformed product F can remain empty entirely.

FIG. 3 also shows the buffer positions for future products K, L, M, N, O, P, R, Q, S.

It should be understood that each hopper 11 to 20 need not be active, so that for example eight inserts from any eight of the hoppers could be provided. More or fewer hoppers could be provided than the ten shown, although preferably at least four and more preferably at least eight hoppers are provided to provide more product flexibility. Sixty hopper lines or more are possible for example.

It also should be understood that in an alternate embodiment to the one shown, the number of buffer positions for the upstream transfer devices can be fewer than the number of buffer positions for the latter transfer devices. In particular, for N hoppers, the Nth transfer device for the Nth hopper needs to have at least N buffer positions, the N−1th transfer device at least N−1 buffer positions, the N−2d transfer device N−2 buffer positions and so on down to the first hopper having at least a single buffer position. Thus, if the first hopper misfeeds, the controller 80 can ensure that downstream transfer devices do not deliver a product to that location. Also, if the Nth hopper misfeeds, the controller 80 can immediately cause the first transfer device 41 not to feed to the conveyor 60.

If for example 60 hoppers are provided, it may be preferable to have for example the first ten hoppers with transfer devices of a length of ten buffer positions, and the $11^{th}$ transfer device with 11 buffer positions, the $12^{th}$ with 12 and so on, with the sixtieth hopper having a transfer device with 60 positions. This reduces the cost and space needed in large collecting devices.

Figure 4:
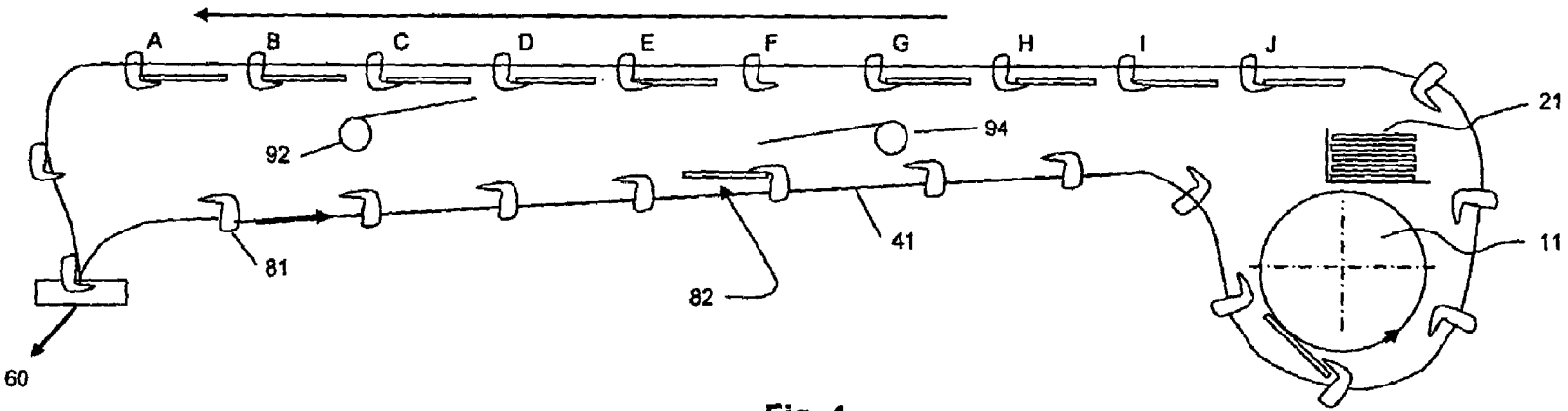
FIG. 4 shows a side view of the collecting device at one of the hopper locations.
Figure 6:
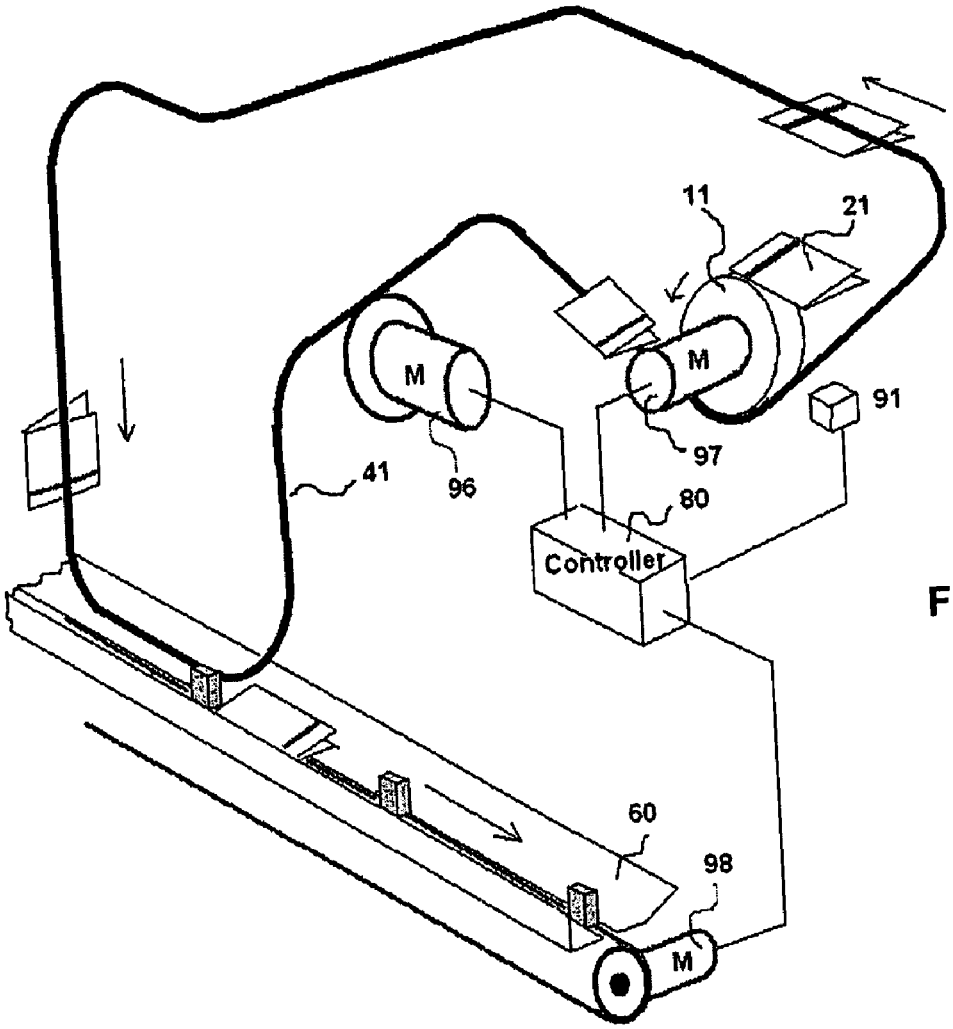
FIG. 6 shows a schematic of the path of one possible path of the transfer device of FIGS. 1 and 5.

FIG. 4 shows a collapsed side view of the collecting device 20 at one of the hopper locations, for example hopper 11. Hopper 11 may be for example a modified RG-318 hopper available from Goss International, Inc. of Dover, N.H., or other hopper. Transfer device 41, which is shown in collapsed fashion but which actually spirals as shown in FIG. 6 and here shows extra buffer positions from those in FIG. 1, may be a gripper conveyor with grippers 81. Each gripper can define one of the buffer positions between the hopper 11 and conveyor 60. The distance between each gripper can be for example 0.5 meters, so that for example in a 50 hopper collecting device, the gripper conveyor distance between the conveyor 60 and hopper 11 can be approximately 25 meters. However, shingling of the grippers would also be possible to reduce the distance. The gripper conveyor, if used as the transfer device, could be for example a GOSS NP-200 gripper system available from Goss International of Dover, N.H. or other gripper system.

If a printed material 21 is not to be delivered on conveyor 60, it can be recycled past hopper 11 again, at which point hopper 11 can be inhibited from delivering a new material 21. If more than one printed material is gripped by a gripper 81, a reject gate 92 or 94 can be provided before or after the conveyor to collect discarded doubles or triples, which can be reused.

Figure 5:
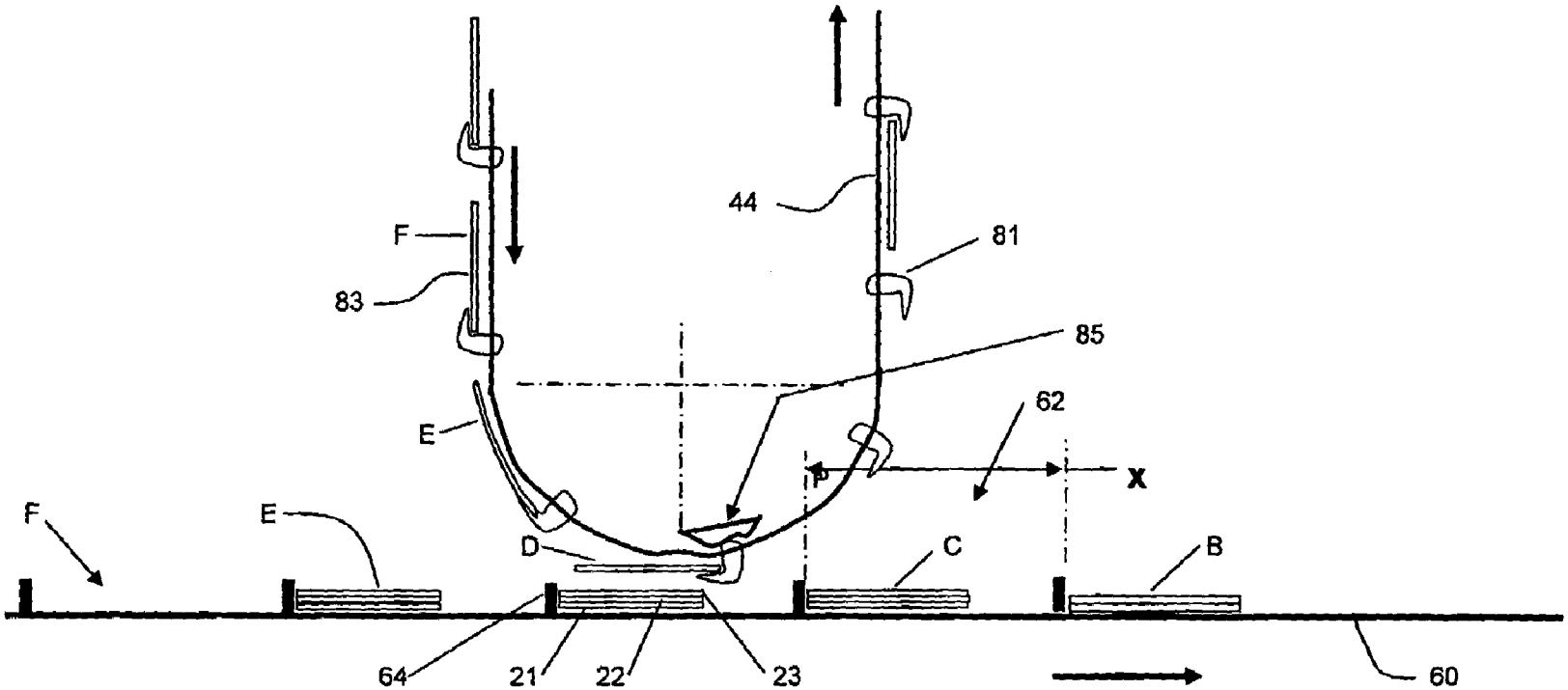
FIG. 5 shows a view of the printed material being deposited on a conveyor by the transfer device.

FIG. 5 shows a view of a possible transfer area for transfer device 44 to conveyor 60 as shown in FIG. 2. Printed materials 21, 22, 23 have been delivered already via transfer device 41, 42, 43 respectively, and a fourth printed material from hopper 14 (FIG. 1) is to be delivered on top of printed material 23 for forming product D. The fourth printed material 83 intended for a not-produced product F is not deposited on conveyor 60, by controller 80 inhibiting a cam 85 which normally causes grippers 81 to release. Thus the gripper 81 for printed material 83 does not release and recycles the printed material back past hopper 14, which can be inhibited by controller 80 from providing a new printed material to that gripper.

Thus the location for intended product F can remain empty as the products are formed and no waste or partial product is created.

While the controller 80 preferably inhibits delivery via controlling the relevant transfer device, the controller also can inhibit delivery via inhibiting the relevant hopper from delivering to the transfer device so that the transfer device does not receive a printed material.

A pin spacing X between pins 64 may be for example 40 cm.

FIG. 6 shows a schematic of the path of one possible path of the transfer device 41 of FIGS. 1 and 5 between conveyor 60 and hopper 11. A servo motor 96 drives the transfer device 41 and can provide encoder information such as phase and number of revolutions back to the controller 80, a servo motor 97 drives the hopper 11 and a servo motor 98 drives the conveyor 60. Each of the conveyors, hoppers, and transfer devices can have home position and servo motor encoder information so that the position of each printed material traveling throughout the device is known.

What is claimed is:

1. A collecting device for forming a printed product comprising:

a conveyor;

a plurality of printed material delivery devices, the plurality of printed material delivery devices including a first delivery device for first printed materials and a second delivery device for second printed materials, a first transfer device assigned to the first delivery device and delivering the first printed materials to the conveyor;

a second transfer device assigned to the second delivery device and delivering the second printed materials to be collected with the first printed materials on the conveyor, the second transfer device being downstream of the first transfer device with respect to the conveyor;

each of the first and second transfer devices having printed material buffer positions between the respective first and second delivery devices and the conveyor, the number of buffer positions for the first transfer device being less than a number of all of the plurality of delivery devices, the number of buffer positions for the second transfer device being greater than or equal to the number of all of the plurality of delivery devices, and a controller determining when the first transfer device has a certain buffer position, the certain buffer position being empty or being a position to be inhibited from delivery, when the certain buffer position passes a first location of the conveyor, the controller inhibiting delivery of the second printed material from the second delivery device to the first location as the first location moves past the second delivery device.

2. The collecting device as recited in claim 1 further comprising a sensor for sensing a misfeed of one of the first printed materials, the certain buffer position corresponding to a misfeed position.

3. The collecting device as recited in claim 2 wherein the certain buffer position corresponds to the absence of the first printed product or to the presence of two or more of the first printed materials.

4. The collecting device as recited in claim 1 wherein the inhibited second printed material is recycled by the second transfer device, and the controller inhibits the second delivery device as the recycled second printed material passes by the second delivery device.

5. The collecting device as recited in claim 1 wherein the first and second delivery devices include sheet material hoppers.

6. The collecting device as recited in claim 1 wherein the first and second transfer devices are gripper conveyors, with each buffer position corresponding to a gripper.

7. The collecting device as recited in claim 1 wherein the conveyor is a saddle conveyor or a perfect binder conveyor.

8. The collecting device as recited in claim 1 wherein the number of printed material delivery devices is at least four.

9. The collecting device as recited in claim 1 wherein the number of printed material delivery devices is at least eight.

10. The collecting device as recited in claim 1 wherein the second transfer device is downstream from the first transfer device with respect to the conveyor.

11. The collecting device as recited in claim 1 wherein the conveyor and transfer devices are driven by individual servo motors controlled by the controller.

12. The collecting device as recited in claim 1 wherein the controller determines when the second transfer device has a second certain buffer position empty or to be inhibited from delivery when the second certain buffer position passes a second location of the conveyor, the controller inhibiting delivery of the first printed material from the first delivery device to the second location as the second location moves past the first delivery device.

13. A collecting device for forming a printed product comprising:

a conveyor;

a plurality of printed material delivery devices, the plurality of printed material delivery devices including a first delivery device for first printed materials and a second delivery device for second printed materials, a first transfer device assigned to the first delivery device and delivering the first printed materials to the conveyor;

a second transfer device assigned to the second delivery device and delivering the second printed materials to be collected with the first printed materials on the conveyor, the second transfer device being downstream of the first transfer device with respect to the conveyor;

each of the first and second transfer devices having printed material buffer positions between the respective first and second delivery devices and the conveyor, the number of buffer positions for the first transfer device being less than a number of all of the plurality of delivery devices, the number of buffer positions for the second transfer device being different than the number of buffer positions for the first transfer device, and a controller determining when the first transfer device has a certain buffer position, the certain buffer position being empty or being a position to be inhibited from delivery, when the certain buffer position passes a first location of the conveyor, the controller inhibiting delivery of the second printed material from the second delivery device to the first location as the first location moves past the second delivery device.

* * * * *